United States Patent [19]

Erickson

[11] Patent Number: 4,512,188

[45] Date of Patent: Apr. 23, 1985

[54] FLOW RATE CONTROL AND METERING MEANS FOR SHEAR-SENSITIVE LIQUIDS

[75] Inventor: Charles D. Erickson, Houston, Tex.

[73] Assignee: Getty Oil Company, Houston, Tex.

[21] Appl. No.: 411,469

[22] Filed: Aug. 25, 1982

[51] Int. Cl.[3] ..... G01F 15/02

[52] U.S. Cl. ..... 73/198; 73/199; 222/276; 222/36; 166/75 R; 417/540

[58] Field of Search ..... 222/1, 71, 129, 130, 222/135, 137, 249, 251, 252, 253, 263, 386, 388, 389, 395, 409, 265, 275, 276, 250; 417/393, 540; 92/9, 8, 12, 143; 166/73 R, 268; 73/198–199, 250–251

[56] References Cited

U.S. PATENT DOCUMENTS

| | | | |
|---|---|---|---|
| 17,654 | 6/1857 | Niles | 73/239 |
| Re. 26,820 | 3/1970 | Bennett | 417/342 X |
| 71,865 | 12/1867 | Fitzgerald . | |
| 245,310 | 8/1881 | Morison | 73/239 X |
| 1,246,180 | 11/1917 | Taylor | 222/275 X |
| 1,377,654 | 10/1921 | Baumgardner | 417/347 |
| 1,777,293 | 10/1930 | Curtis et al. | 222/250 X |
| 2,525,295 | 10/1950 | Harrington | 222/250 X |
| 2,690,715 | 10/1954 | Pope | 417/342 |
| 2,838,140 | 6/1958 | Rasmusson et al. | 92/9 X |
| 2,998,164 | 8/1961 | Clements | 222/275 X |
| 3,216,627 | 9/1965 | Best et al. . | |
| 3,477,380 | 11/1969 | Johanson et al. . | |
| 3,778,193 | 11/1973 | Reinert | 417/342 |
| 4,103,490 | 8/1978 | Gorlov | 417/347 X |
| 4,269,569 | 5/1981 | Hoover | 417/347 X |

FOREIGN PATENT DOCUMENTS

| | | | |
|---|---|---|---|
| 369209 | 2/1932 | United Kingdom . | |
| 854456 | 11/1960 | United Kingdom . | |
| 1034763 | 7/1966 | United Kingdom . | |
| 1305729 | 2/1973 | United Kingdom | 222/250 |

*Primary Examiner*—H. Grant Skaggs

*Attorney, Agent, or Firm*—Jack H. Park; Edmund F. Bard; D. Arlon Groves

[57] ABSTRACT

In a flow rate control apparatus, pressure of a primary, or controlled, liquid is reduced without application of shear forces thereto. Each of first and second piston and cylinder assemblies has a first port on one side of the piston and a second port on the other side. A secondary fluid path between the two second ports contains a controlling fluid directed through a pressure reducing valve. The rate of flow of the primary fluid from the discharge cylinder is controlled by the rate of flow of the secondary fluid through the pressure reducing valve. A four way valve couples the controlled liquid at relatively high pressure through the first port in a first cylinder, and the controlled liquid is discharged at relatively low pressure from the first port in the second cylinder. The first and second pistons are rigidly connected to assure synchronized motion and accurate metering of the controlled liquid and to provide for driving of both pistons in response to input pressure of the controlled liquid.

8 Claims, 7 Drawing Figures

1
2
3
10
11
12
13
18a
18b
18c
19a
19b
19c
20a
20b
20c
24a
24b
24c
28a
28b
28c
33
37
38
39
40
41
43
45
48
51a
51b
51c
52a
52b
52c
54
68a
68b
68c
69a
69b
69c
71
72

B
1
1
1
A

FLOW RATE CONTROL AND METERING MEANS FOR SHEAR-SENSITIVE LIQUIDS

BACKGROUND OF THE INVENTION

This invention relates to flow control means and more particularly to means and a method for reducing pressure in the flow of a shear-sensitive liquid.

Shear-sensitive liquids include various polymer solutions, carboxymethyl-cellulose, hydroxyethyl-cellulose, latex polymers, polysaccharides, and the like. Important examples of shear-sensitive liquids are liquid polymer solutions used in oil recovery flooding operations such as polyacrylamide solutions. In flooding techniques, liquid is injected into a formation to displace oil therefrom. A large body of prior art has developed in the use of various liquids under selected conditions. Many different types of water solutions including cosurfactants have been used. Flooding with polymer solutions has gained popularity in use since it can provide the ability to sweep greater fractions of reservoir volume in comparison to conventional waterfloods.

One of the most important characteristics of polymer solutions is their viscosity. Due to their molecular structure, viscous polymer solutions are subject to mechanical degradation when subjected to shear forces. In use, however, the potential for application of such forces is continually present.

In flooding operations, a large amount of polymer solution must be provided from one source, such as a mixing tank, to several wellheads some of which will usually be remote from the polymer supply source. The polymer solutions are pumped to wellheads by one or more large positive displacement pumps. Typical supply pressures may be as high as 2500 psig. However, the discharge pressure into the wellhead is a function of the well characteristics and the geology of the formation. The well could represent a very low resistance to flow, and therefore require a low pressure input. It is necessary to provide a means of flow control to reduce the pressure from the high pressure polymer source to the low pressure well. Mere use of a pressure reduction valve would result in turbulence and the creation of shear forces which would reduce the viscosity of the liquid polymer. A throttle valve, for example, can cause serious degradation in terms of decrease in viscosity. Various solutions to the problem of providing shear-sensitive liquids from a high pressure source to a low pressure input have been used, but all prior devices and methods have various drawbacks.

A highly satisfactory solution has been disclosed in commonly assigned applications Ser. No. 322,729 filed by Peter L. Sigwardt on Nov. 19, 1981. The apparatus of that application provies a flow rate controller for an input supply of relatively high pressure controlled liquid and the discharge therefrom of controlled liquid at a reduced pressure relative to the pressure of the input supply of controlled liquid. The flow rate controller of Application Ser. No. 322,729 provides means for directing the input portion of high pressure controlled liquid into contact with a first movable barrier in a high pressure displacement chamber to impose through said first barrier a relatively high pressure upon a substantially confined portion of control liquid on the opposite side of the first barrier. The high pressure control liquid is conveyed through a control conduit having a flow control means therein into a reduced pressure displacement chamber, and means for transmitting pressure of the reduced pressure control liquid through a second movable barrier to displace from the reduced pressure chamber a portion of the controlled liquid at a lower pressure than the pressure of the input controlled liquid.

In the operation of this apparatus, control liquid is introduced alternately against the first barrier and then the second barrier and it is alternatively expelled by the second barrier and then the first barrier at a pressure determined by the input pressure against the resistance provided by the input controlled liquid and the flow control means connected between the displacement chambers. Liquids which may be used as the control liquid in the apparatus of the referenced invention as well as the present invention include water, aqueous solutions of glycols or glycerin, hydrocarbon oils, synthetic oils or the like.

In the present invention, improvements are provided in this means and method.

SUMMARY OF THE INVENTION

It is therefore an object of the present invention to provide a flow control means in which a controlled liquid urges a movable barrier against a controlling liquid whose flow is controlled by valve means to control the displacement of said movable barrier and said movable barrier causes a connecting linkage to urge another barrier to expel controlled liquid at a desired, reduced pressure and at a controlled rate of flow.

It is a further object of the present invention to provide a flow control apparatus of the type described further comprising metering and measuring means for the controlled liquid.

It is also an object of the present invention to provide a method in which movement of barrier means is synchronized in first and second chambers in each of which the movement of one of said barrier means causes flow of a portion of a controlled liquid from one chamber and an equal volume of a control liquid from the other chamber.

Briefly stated, in accordance with the present invention there is provided a flow control means and method in which first and second piston and first and second displacement chambers are provided. Said first and second pistons are moved in said cylinders in a first direction when a portion of primary, controlled liquid enters at a relatively high pressure into a first displacement chamber and another portion of primary liquid is expelled at a lower pressure from a second displacement chamber. Pressure of the controlled liquid urges the first piston against the controlling liquid which is forced into a fluid circuit including a flow control valve for reducing pressure. As secondary, control liquid is expelled from the first cylinder, it is received in the second cylinder. The first and second pistons are rigidly linked together for synchronization of movement and to provide for positive displacement of primary liquid from the second chamber at a rate controlled by the flow of secondary liquid through the flow control valve.

BRIEF DESCRIPTION OF THE DRAWINGS

The means by which the foregoing objects and features of invention are achieved are pointed out with particularity in the claims forming the concluding portion of the specification. The invention, both as to its organization and manner of operation may be further understood by reference to the following drawings taken in connection with the following description.

Of the Drawings.

DESCRIPTION OF THE PREFERRED EMBODIMENTS

Figure 1:
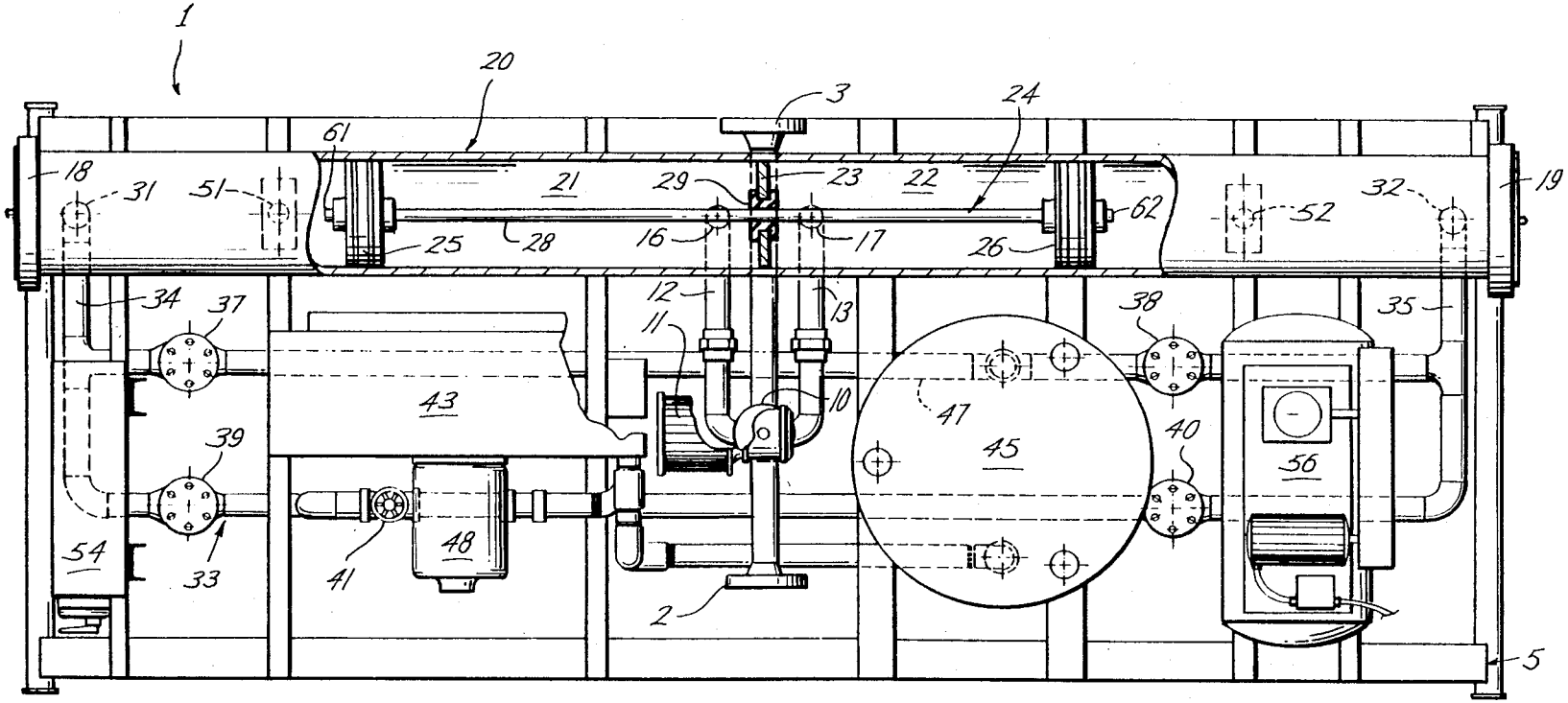
FIGS. 1 and 2 are respectively a plan view and an elevation of a flow control apparatus constructed in accordance with the present invention suitable for providing shear-sensitive liquid in large volume from a high pressure source to a low pressure usage.
Figure 2:
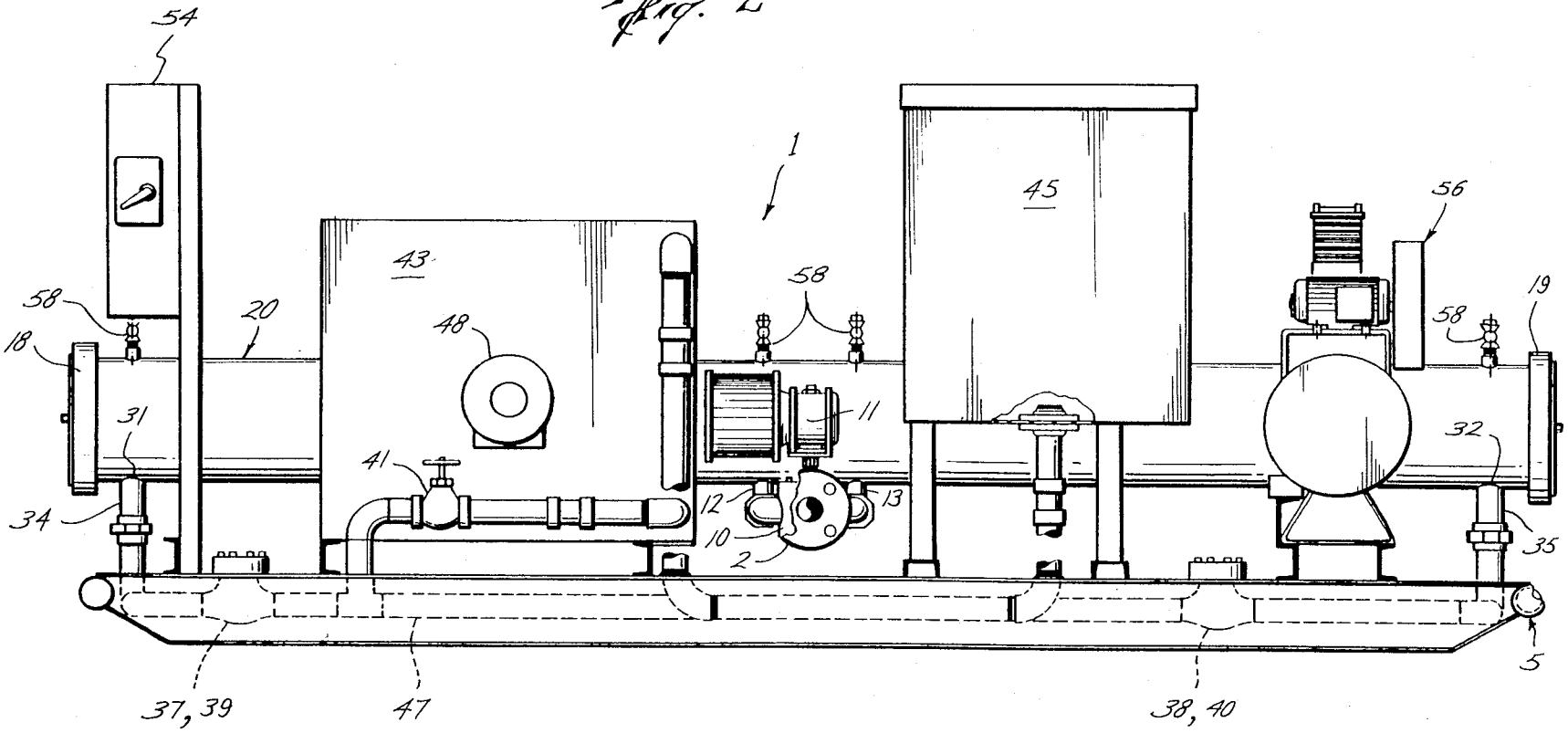

FIGS. 1 and 2 respectively are a plan view partially broken away and an elevation of an embodiment of the present invention utilized for providing flooding polymer from a central tank (not shown) and pumped at high pressure by low shear positive displacement pumps to a wellhead. In FIGS. 1 and 2 (as well as in FIGS. 3, 4 and 5 further described below) the same reference numerals are used to denote corresponding components. This embodiment may, for example, find application at an oil field in which polymer solution is provided from a central source for many wellheads which source may be, for example, 500 to 4500 feet or more away from the wellhead. Consequently, to be conducted to the wellhead, the polymer solution must be delivered at high pressure. The flow rate control and metering system 1 of the present invention receives what will be referred to as primary or controlled fluid, in the present example polymer solution such as polyacrylamide, at its source input pressure at an inlet 2 and provides the controlled fluid at a reduced pressure at an outlet 3 while preventing turbulence and application of shear forces to the controlled fluid. The system 1 is preferably mounted on a support skid 5 for placement in an oil field.

The inlet 2 is connected to a flow diverter means 10, for example, a four way valve 10 operated by a valve actuator 11. The flow diverter means 10 could comprise multiple valve systems appropriately synchronized. For ease of description, the flow diverter means 10 is referred to as the valve 10. The valve actuator 11 as illustrated herein is pneumatically operated. Other types of valve actuators 11 such as electrically or hydraulically operated valve actuators may be similarly utilized.

In a first position, the inlet 2 is connected by the valve 10 to a conduit 12, and the outlet 3 is connected by the valve 10 to a conduit 13. In an opposite position of the valve 10, the inlet 2 and outlet 3 are respectively connected to the conduits 13 and 12. Ends of the conduits 12 and 13 remote from the valve 10 are connected to first ports 16 and 17 of a cylinder 20 closed by end caps 18 and 19 and more particularly to first and second displacement chambers respectively 21 and 22 on opposite sides of a wall 23 normal to an axis defining the cylinder 20. The wall 23 functions as a static flow barrier. In operation, the cylinder 20 will receive controlled fluid from the inlet 2 via the conduit 12 or 13 at a first, high pressure and expel the controlled fluid from the outlet 3 via the conduit 13 or 12 at a reduced pressure. The ports 16 and 17 are primary ports for transmitting the primary, controlled fluid.

A piston assembly 24 includes a first barrier means, a piston 25 which is provided for reciprocal motion in the chamber 21, and a second barrier means, a piston 26 which is provided for reciprocal motion in the chamber 22. A connecting rod 28 disposed in the direction of travel of the pistons 25 and 26 connects the pistons 25 and 26. The pistons 25 and 26 each provide a seal between respective portions of the chambers 21 and 22 housing controlling and controlled liquid. Sealing means 29 surround the connecting rod 28 where it passes through the wall 23. The controlled fluid remains between the inlet 2, the pistons 25 and 26 and the outlet 3. The pistons 25 and 26 may be formed to include stop means for engaging the end caps 18 and 19 respectively. Other means such as an extension of rod 28, for example, may be used to limit the stroke of the piston assembly 24.

Controlling, or control, fluid on which pressure reduction is directly performed during operation moves into and from the remainder of the chambers 21 and 22 on the opposite sides of the pistons 25 and 26 respectively. Second ports 31 and 32 respectively connect the chambers 21 and 22 to a secondary fluid circuit 33. The ports 31 and 32 are secondary ports for transmitting the secondary, controlling fluid. Conduits 34 and 35 respectively couple the ports 31 and 32 to opposite sides of the fluid circuit 33. First and second check valves 37 and 38 are connected for flow from the fluid circuit 33 into the conduit 34 or 35 respectively. Third and fourth check valves 39 and 40 are connected for flow into the fluid circuit 33 from the conduit 34 or 35 respectively.

A rate control valve 41 is provided to restrict flow of the secondary fluid and to provide a back pressure against the pressure applied by the primary liquid and to control the incoming flow of the primary liquid. The rate control valve 41 may be a flow rate control valve, a throttling valve or the like since turbulence and shear force applied to the secondary fluid are of no consequence. The valve 41 may be adjusted manually or in response to control means referred to below. The rate control valve 41 is coupled to receive fluid flow from the check valve 39 or 40.

The rate control valve 41 provides an output through a heat exchanger 43 having an outlet connected to a fluid reservoir 45 from which control liquid is conveyed to check valves 37 and 38, one of which will open depending on the direction of fluid flow. The heat exchanger 43 may include a motor and fan assembly 48 to aid in heat exchange. The heat exchanger 43 may be bypassed or eliminated in applications in which heat generated will not (at the valve 41) adversely affect performance of the system. The fluid reservoir 45 preferably is maintained at or near atmospheric pressure to accommodate thermal expansion and contraction of the control fluid. A slight pressure above atmospheric pressure may be maintained to minimize control fluid evaporation.

The check valves 37 through 40 are directed such that liquid expelled from either chamber 21 or 22 in the cylinder 20 will be directed in one direction through the rate control valve 41. When fluid is expelled from the chamber 21, it is passed through the check valve 39; when fluid is expelled from the chamber 22, it is directed through the check valve 40 to the rate control valve 41. This hydraulic arrangement comprises means for providing a unidirectional flow through the rate control valve that governs pressure reduction of the controlling fluid and the rate of flow of the controlled fluid from the unit. Similarly, the check valves 37 and 38 are directed for providing fluid flow from the reservoir 45 into the cylinder 20 with the check valve 37 directing flow into the chamber 21 and the check valve 38 directing flow into the chamber 22 depending upon the direction of motion of the piston assembly 24.

Sensing means are provided to detect travel of the piston assembly 24 and may include first and second sensors 51 and 52 for counting strokes of the piston assembly 24 which are electrical proximity sensors mounted in the wall of the cylinder 20. The sensors 51 and 52 may comprise electrical sensors mounted in stainless steel inserts in the wall for detecting ferrous masses such as the pistons 25 and 26 and they are positioned respectively adjacent opposite extremities to which the pistons 25 and 26 will travel and produce a signal such as a pulse each time the piston assembly 24 completes a stroke. Alternatively, the sensors 51 and 52 could comprise mechanical or other well-known forms of switches. The sensors 51 and 52 provide outputs, preferably in the form of pulses, to control means 54 which registers the passage of fluid through the subject assembly and which also operates the valve actuator 11.

Since each stroke of the piston assembly 24 in one direction represents expulsion of a fixed amount of fluid from the chamber 21 and since each stroke of the piston assembly 24 in the other direction represents expulsion of a fixed amount of fluid from the chamber 22, the pulses produced by the sensors 51 and/or 52 are coupled to indicate the amount and rate of controlled fluid pumped. The control means 54 comprises means for counting and storing the number and rate of pulses produced by the sensors 51 and 52. The production of a sensor pulse indicates completion of a stroke of the piston assembly 24 and the control means 54 therefore also includes means for operating the valve actuator 11 in response thereto. The rate measurement measured in any desired units of flow per unit of time may be used to provide an output for adjusting the flow control valve 41 to create a pressure drop resulting in a preselected flow rate at the outlet 3.

Accuracy is maintained since the connecting rod 28 prevents loss of synchronism of the pistons 25 and 26. The connecting rod 28 also provides for positive displacement. Both pistons 25 and 26 are moved in response to input pressure of the controlled liquid. It is not necessary to rely on one piston 25 or 26 being urged by the secondary, controlling liquid while the other is moved by the controlled liquid. Travel of the piston assembly 24 may be limited by stop means 61 and 62 which may comprise portions of the pistons 25 or 26 or ends of the rod 28 for engaging the end caps 18 or 19 respectively.

Pneumatic pressure is applied to operate the valve actuator 11 from an air compressor and compressed air reservoir assembly 56 or other pressurized gas source. Valve ports 58 may be provided at which pressure gauges may be placed to monitor pressure in various portions of the cylinder 20.

OPERATION

Figure 3:
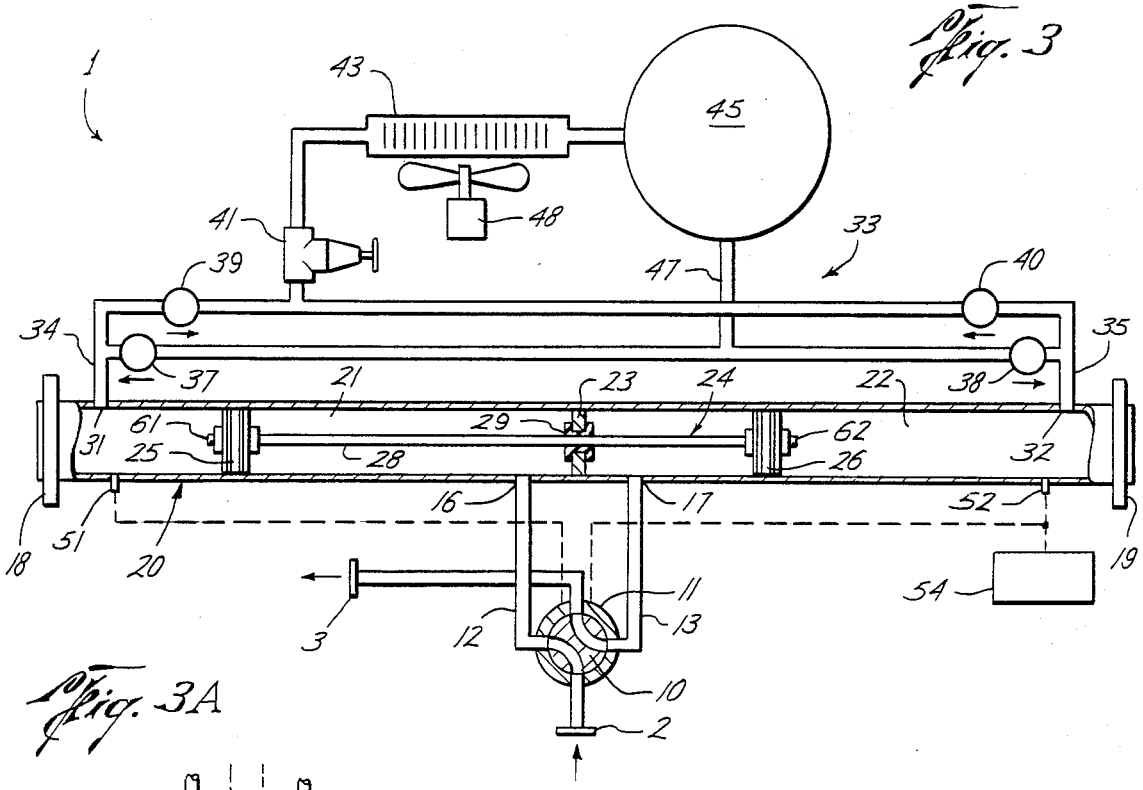
FIG. 3 is a hydraulic schematic representation of the apparatus of FIGS. 1 and 2.
Figure 3A:
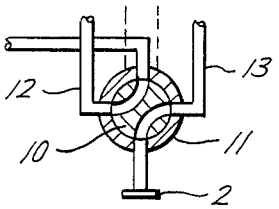
FIG. 3*a* is a partial view of FIG. 3 illustrating an alternate state of the apparatus.

Operation and further details of the subject structure are explained with respect to FIG. 3, in which the cylinder 20 is shown in cross-sectional form, and other elements of the hydraulic circuitry herein are shown in schematic form. FIG. 3*a* is a partial reproduction of FIG. 3 in which the valve 10 is shown in its alternate position with respect to the position illustrated in FIG. 3. In operation, the valve 10 is set in a first position by the control means 54. In the present example, the valve position is selected in which the inlet 2 is coupled to the conduit 12 to provide an input to the port 16 of the chamber 21 and the outlet 3 is coupled to the port 17 of the chamber 22 via the conduit 13. Controlled, primary fluid, such as polymer solution at, for example, 2500 psig is received in the chamber 21 to urge the piston assembly 24 toward the end cap 18. Secondary, control fluid is urged from the chamber 21 through the port 31 through the secondary fluid circuit 33. In this case, the secondary fluid is coupled in the direction of passage of the check valve 39 to the rate control valve 41. Rate control valve 41 is adjusted to provide the desired rate of flow of secondary liquid from chamber 21 which in turn controls the rate of displacement of piston 25 and the rate of input of primary liquid into chamber 21. The secondary fluid then passes through the heat exchanger 43 to the reservoir 45 and is directed through the check valve 38 through the port 32 into the chamber 22 on the opposite side of the piston 26 from the primary fluid.

The movement of piston 25 provides synchronized movement of piston 26 because the two pistons are connected by rod 28. Consequently, primary fluid is expelled from the chamber 22 by the piston 26 out the port 17 through the conduit 13 to the outlet 3. The rate of flow is controlled by the displacement rate of piston 25. After a preselected displacement, the sensor 51 senses the extreme of travel by the piston 25 and provides an output signal to the control means 54. Consequently, the valve 10 is switched by the valve actuator 11 to the position shown in FIG. 3*a*. Pressurized primary fluid is then directed from the inlet 2 to the conduit 13 through the port 17 into the chamber 22 to urge the piston 26 to its full length of travel which is then detected by the sensor 52. Again, secondary fluid is forced from the chamber 22 through the check valve 40 to the rate control valve 41 continuing in the fluid circuit 33 through the heat exchanger 43 and reservoir 45 through the check valve 37. The secondary fluid is drawn into the port 31 and chamber 21.

Linking the pistons 25 and 26 with the connecting rod 28 assures that the pistons maintain a constant displacement volume between them. Synchronization of input and output cycles of the primary fluid is assured. Consequently, a smooth, substantially continuous flow may be provided at the outlet 3. The presently preferred embodiment is particularly advantageous in that the connecting rod 28 is maintained in tension. This maximizes the load which can be borne thereby. A corresponding connecting rod 28 placed in compression would have a greater tendency to bend when made in the same dimensions and withstanding the same load. The input pressure of the controlled fluid in the inlet 2 less the back pressure produced by the valve 41 plus the pressure at the outlet 3 equals the tension on the rod 28. The "end to end" relative disposition of the chambers 21 and 22 is advantageous in that it lends itself to efficient construction out of a unitary cylinder member 20.

Figure 4:
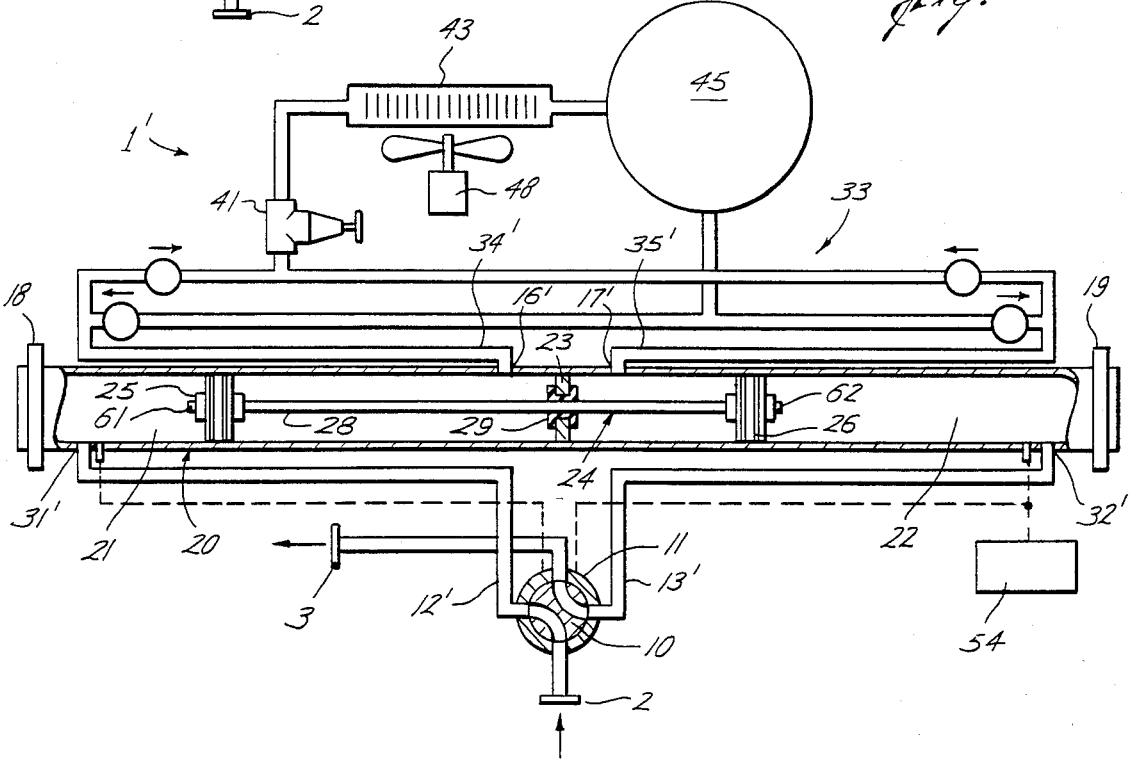
FIG. 4 is an illustration of a further embodiment of the present invention also shown in schematic form.

FIG. 4 represents a further embodiment 1' in which the secondary fluid circuit is connected between ports adjacent a central portion of the cylinder 20, and the primary fluid circuit is connected to the extremities of the cylinder 20.

In the embodiment of FIG. 4, the four way valve 10 is connected to a conduit 12' providing an input to a port 31' at an extremity of the cylinder 20 and a conduit 13' is connected to a port 32' at an opposite extremity of the cylinder 20. The secondary fluid circuit 33 is connected by conduits 34' and 35' to ports 16' and 17' on opposite sides of the central wall 23. Operation proceeds as in the embodiment of FIG. 3. However, the ports 16' and 17' are regarded as "second" ports and the ports 31' and 32' are regarded as first ports (in contradistinction to the description of FIGS. 1 and 2 above). In this embodiment, the primary fluid pushes against both pistons 25 and 26 and against the connecting rod 28 rather than pushing one piston while "pulling" the other.

Figure 5:
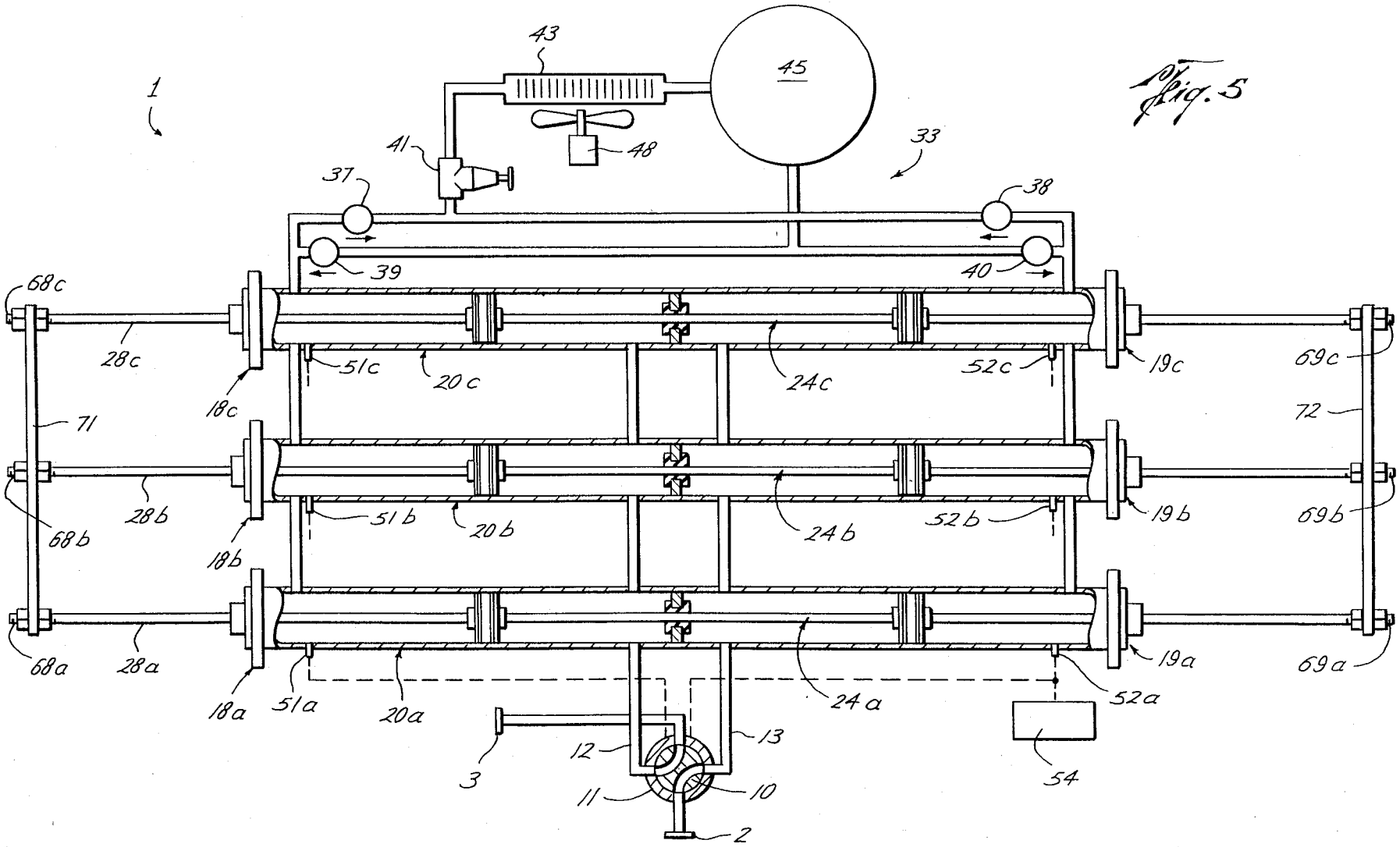
FIG. 5 is an illustration demonstrating a further embodiment of the flow control means of the present invention.

FIG. 5 is a further hydraulic schematic illustration in which corresponding reference numerals are again used to denote corresponding elements in which first, second and third cylinders 20*a*, 20*b* and 20*c* are provided. These cylinders respectively have end caps 18*a*, 18*b* and 18*c* at one end thereof, which is the left side in FIG. 5 and end caps 19*a*, 19*b* and 19*c* at an opposite end thereof, which is the right hand side in FIG. 5. Connecting rods 28*a*, 28*b* and 28*c* extend through the end caps 18*a*, 18*b* and 18*c* terminating at extremities 68*a*, 68*b* and 68*c* respectively and through end caps 19*a*, 19*b* and 19*c* terminating at extremities 69*a*, 69*b* and 69*c* respectively. Synchronizing means are provided to assure that the connecting rods 28*a*, 28*b* and 28*c* operate in unison. The synchronizing means may comprise a first connector plate 71 connecting the extremities 68*a*, 68*b* and 68*c* and a second connector plate 72 connecting the extremities 69*a*, 69*b* and 69*c* of the connecting rods 28*a*, 28*b* 28*c* respectively. Again, operation proceeds as in the embodiment of FIG. 3. The construction of FIG. 5 allows for a modular construction wherein a plurality of more or less than three cylinders may be used. The number of cylinders used will increase the total of rate pumping available. Since at the well head space may be at a premium or on an offshore rig space is definitely at a premium, by multiplying the number of cylinders 20 used, the overall length of the unit 1 may be reduced.

It should be noted that a tradeoff must be made in selecting the length of the cylinder 20. The longer the cylinder, the longer the unit will last and the smoother its pumping characteristics, and the greater the capacity per stroke. On the other hand the longer cylinders are more costly and require more space. If very short cylinders are provided, a proportionately greater number of strokes must be made for the same output.

In the present invention, since the opposing pistons 25 and 26 have their movement positively related by the connecting rod 28, positive, synchronized displacement metering is provided. The number of strokes may be counted by the sensing means 51 and 52 and this number has a one to one, accurate correspondence with the amount of primary liquid pumped. Further, in the event of a leak or other condition which could otherwise adversely affect synchronization of the two pistons, synchronization will still be maintained by the connective linkage of the pistons. This prevents uncertainty in switching of the input/output four way valve 10 and maximizes smoothness in flow of output fluid from the outlet 3.

In the embodiment of FIG. 5, an alternative form of synchronization may be provided. Sensors 51*a* and 51*b* are provided in the cylinder 20*a*. Sensors 51*b* and 52*b* and sensors 51*c* and 52*c* are provided in the cylinders 20*b* and 20*c* respectively and coupled to the control means 54. Either the sensors 51*a*, 51*b* and 51*c* or the sensors 52*a*, 52*b* and 52*c* must all provide an output indicate of completion of a stroke of the piston assemblies 24*a*, 24*b* and 24*c* to initiate operation of the valve actuator 11. In this form of the invention, the plates 71 and 72 extensions of the rods 28*a*, 28*b* and 28*c* are not required.

Figure 6:
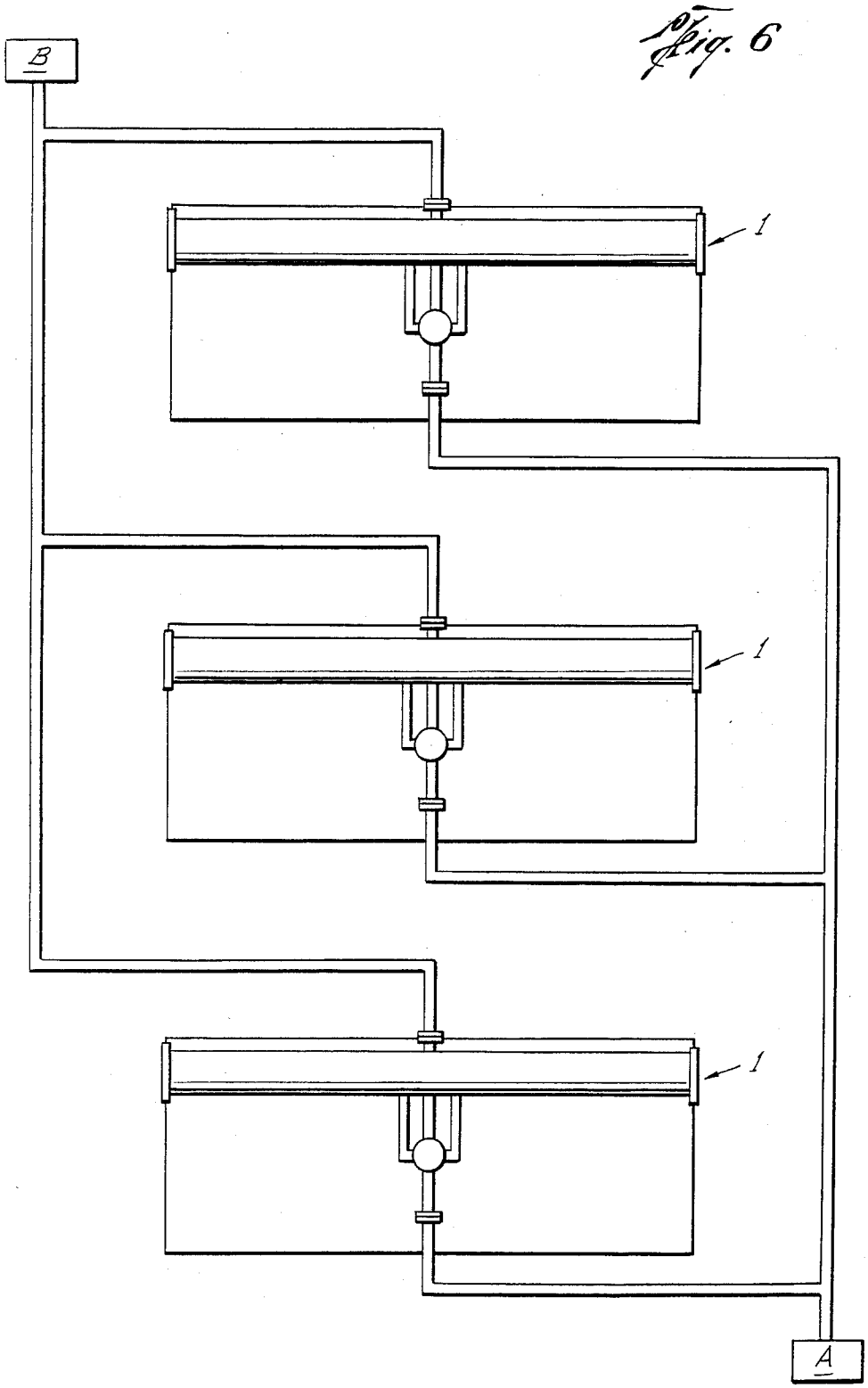
FIG. 6 is an illustration of an embodiment providing for increased capacity compared to the embodiment of FIG. 1.

Flow capacity may be increased as required by manifolding multiple flow controller systems 1 or units in parallel as shown in FIG. 6, which is a diagrammatic representation of a plurality of systems each constructed according to FIG. 1. In the manifold arrangement of this embodiment, the number of units 1 placed in service may be varied as required by wellhead demand. All units 1 are connected in parallel between a source A and a wellhead B. The term wellhead here means any usage to which the controlled fluid may be connected, and could be a non-oil field usage. In FIG. 6 units 1 are shown, but systems 1' could be provided. In this embodiment, synchronization of any one unit 1 with relation to another is not required. This embodiment provides the advantage of the ability to increase capacity through the use of multiple standard units.

It is therefore apparent that the present invention is one well adapted to obtain all of the advantages and features hereinabove set forth, together with other advantages and features hereinabove set forth, together with other advantages which will become obvious and inherent from the description of the apparatus itself. It will be understood that certain combinations and subcombinations are of utility and may be employed in various flow control or metering applications without reference to other features and subcombinations. This is contemplated by and within the scope of the present invention.

What is claimed as new and desired to be secured by Letters Patent of the United States is:

1. In a system having a high pressure pumping means for injecting a viscous shear-sensitive liquid into a subsurface earth formation, an adjustable flow control assembly comprising an elongate cylinder means having a pair of first ports adjacent opposite ends thereof, a pair of second ports adjacent the middle of said cylinder means, and an annular wall member fixedly disposed between said pair of second ports, a piston assembly comprising a rod member slidably positioned through said wall member and having a first piston head disposed at one end between and isolating the ports on one side of said wall member from each other and a second piston head disposed at the other end of said rod member between and isolating the ports on the other side of said wall member from each other, a control valve means interconnected with said second ports for conducting shear-sensitive liquid from said pumping means into said cylinder means between said wall member and one of said piston heads and for displacing shear-sensitive liquid into said formation from between said wall member and the other of said piston heads, and a flow regulating means interconnected between said first ports for conducting a control liquid from between said one piston head and the first port adjacent thereto to the interior of said cylinder means between said other piston head and the other of said first ports at a flow rate functionally related to the rock pressure in said formation.

2. The flow control assembly described in claim 1, wherein said piston assembly substantially isolates said shear-sensitive liquid from said control liquid in said cylinder means.

3. The flow control assembly described in claim 2, further comprising metering means for measuring the displacement of shear-sensitive liquid to said formation.

4. The metering means described in claim 3, comprising first sensor means disposed at one end of said cylinder means for generating a first indication in response to said first piston head, second sensor means disposed at the other end of said cylinder means for generating a second indication in response to said second piston head, and counting means interconnected with said sensor means and responsive to said indications.

5. The metering means described in claim 4, wherein said first sensor means generates said first indication as a function of displacement of shear-sensitive liquid from said cylinder means by said second piston head and said second sensor means generates said second indication as a function of displacement of shear-sensitive liquid from said cylinder means by said first piston means.

6. The flow regulating means described in claim 5, comprising an adjustable flow control valve having an input portion interconnected to receive control liquid from said cylinder means and an output portion for discharging such control liquid, and an expansion chamber having an intake for receiving such discharged control liquid and an outlet interconnected with said cylinder means.

7. The flow regulating means described in claim 6, further including cooling means interconnected with said flow control valve and said expansion chamber.

8. The flow regulating means described in claim 7, further comprising first check valve interconnected with and openable to conduct control liquid from one of said first ports in said cylinder means to said input portion of said flow control valve, second check valve intereconnected with and openable to conduct control liquid from the other of said first ports in said cylinder means to said input portion of said flow control valve, third check valve interconnected with and openable to conduct control liquid from the outlet of said expansion chamber to said one first port in said cylinder means, and fourth check valve interconnected with and openable to conduct control liquid from the outlet of said expansion chamber to said other first port in said cylinder means.

* * * * *